United States Patent [19]

Giorgi et al.

[11] 3,973,157

[45] Aug. 3, 1976

[54] CHARGED-PARTICLE TRAPPING ELECTRODE

[75] Inventors: Tiziano A. Giorgi; Paolo della Porta, both of Milan, Italy

[73] Assignee: S.A.E.S. Getters S.p.A., Milan, Italy

[22] Filed: Jan. 7, 1975

[21] Appl. No.: 539,101

[30] Foreign Application Priority Data

Jan. 7, 1974 Italy ..... 19141/74

[52] U.S. Cl. ..... 313/353; 204/37 R; 313/106; 315/5.11; 315/5.38

[51] Int. Cl.[2] ..... H01J 1/02; H01J 1/14; H01J 1/38; H01J 1/48

[58] Field of Search ..... 315/39.51, 5.11, 5.12, 315/5.38; 313/106, 107, 353; 204/37, 30

[56] References Cited

UNITED STATES PATENTS

| | | | |
|---|---|---|---|
| 3,324,341 | 6/1967 | Epsztein | 315/39.51 X |
| 3,350,594 | 10/1967 | Davis et al. | 313/106 X |
| 3,558,445 | 1/1971 | Rix et al. | 204/37 R |
| 3,679,552 | 6/1970 | Jervis | 204/37 T |

*Primary Examiner*—Saxfield Chatmon, Jr.
*Attorney, Agent, or Firm*—Littlepage, Quaintance, Murphy & Dobyns

[57] ABSTRACT

A charged particle collecting body forming part of an electrode comprises a three dimensional network defining a multiplicity of interconnecting free cells.

The dimensions of the cells are selected to permit a major portion of charged particles incident thereon to penetrate a number of free cells before impinging on a strut of the three-dimensional network.

6 Claims, 3 Drawing Figures

CHARGED-PARTICLE TRAPPING ELECTRODE

BACKGROUND OF THE INVENTION

1. Field of the Invention

This invention pertains generally to electrodes charged particle accelerating and storing devices and particularly to anode structures intended to be maintained at a positive potential having specific features to reduce secondary emission and sputtering phenomenon.

2. Description of the Prior Art

Many devices make use of the flow of molecular atomic or subatomic particles in a controlled ambient.

The ambient may be a vacuum or a known pressure of desired gases depending upon the function required of the particular device. The particles may be electrons or electrically charged ions or molecules.

These devices are usually associated with means for accelerating the particles such as a system of electrodes whose potentials are known.

Frequently, use is also made of magnetic fields. Whatever the nature of the particles may be they are usually in motion and so possess a kinetic energy. In some cases, in order to perform their desired function, the primary particles are caused to impinge upon a target. For instance in the case of a thermionic valve electrons emitted from a cathode are accelerated by an electric potential thus gaining kinetic energy and eventually are collected upon an anode, whereupon the kinetic energy of the electrons is at least partially transformed into other forms of energy.

In other cases the particles may deviate from their intended path and impinge upon surfaces within the device upon which they are not intended to impinge. Such is often the case in devices known as particle storage devices or accelerators such as cyclotrons, betatrons etc. Furthermore the controlled beam of particles may collide with molecules or atoms of the residual gas atmosphere of the device causing these molecules or atoms to undesirably impinge upon surfaces within the device.

When a particle impinges upon a surface several phenomena may occur depending upon the kinetic energy and nature of the particle and the surface. The kinetic energy of the particle may be transformed into vibrations of the atomic lattice constituting the impacted surface and thus manifests itself as heat. The energy of the particle may be transferred to only one or a few of the atoms of the impacted surface lattice in which case these atoms may become detached from the surface. Such detached atoms can deposit upon other surfaces within the device. This phenomenon known as sputtering is usually undesirable. The impinging particle may cause the surface to re-emit charged particles such as in the well known effect of secondary electron emission. Again such secondary emission is very often undesirable. Alternatively the particles may simply be reflected. Thus a surface which, intentionally or unintentionally is impinged upon by particles can cause undesirable effects.

It is therefore an object of the present invention to provide a particle collecting body which is substantially free from one or more of the defects of previously known particle collecting surfaces.

Another object of the present invention is to provide a particle collecting body which is substantially free from sputtering.

A further object of the present invention is to provide a particle collecting body which is substantially free from secondary electron emission.

Yet another object of the present invention is to provide an electron or charged particle device containing at least one particle collecting body which is substantially free from sputtering or secondary electron emission.

Further objects and advantages of particle collecting bodies according to the present invention will be obvious to those skilled in the art from the following detailed description thereof.

SUMMARY OF THE INVENTION

Figure 1:
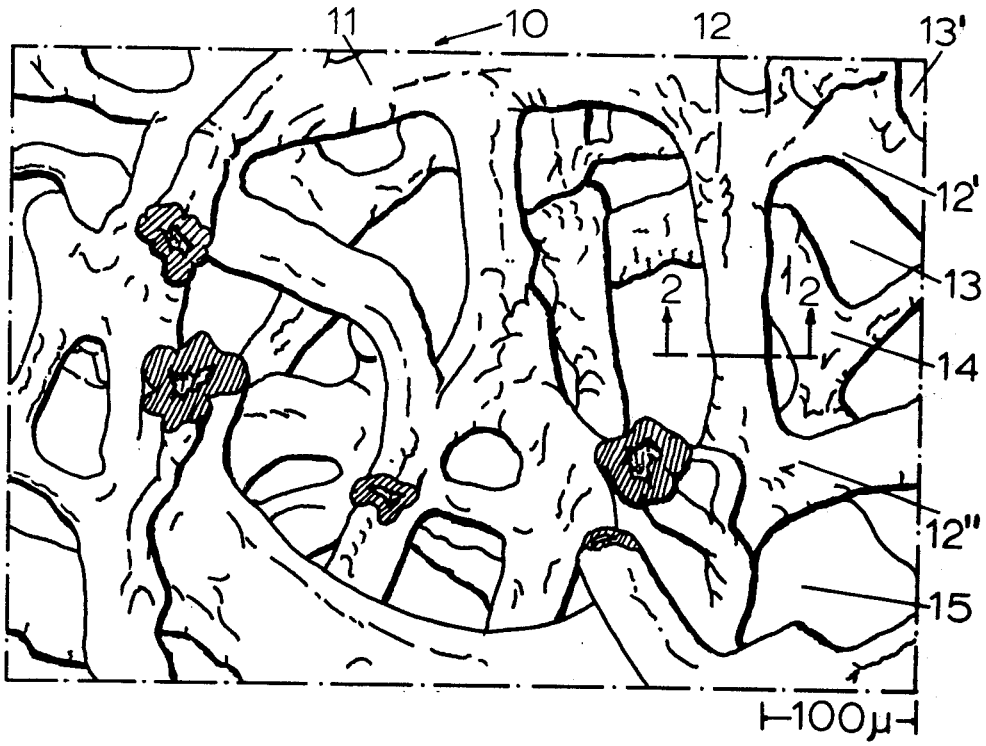
FIG. 1: is an enlarged representation of a particle collecting body of the present invention.

According to the present invention there is provided a molecular, atomic or sub-atomic particle trapping body comprising a three dimensional network defining a multiplicity of inter-connecting free cells. Such three-dimensional networks are well known and methods for their preparation are illustrated in United Kingdom Pat. No. 1.263.704 and No. 1.289.690. See also U.S Pat. No. 3.679.552. These three-dimensional networks have been used in the past to trap airborn particles such as dust or pollen. Presumably they act by changing the flow characteristics of the dust carrying air and functioning as a mechanical filter as the pore size of the filter is smaller than the size of the dust particle. Whatever the means by which the dust particles are trapped they impinge upon the network with such a low energy per unit mass that secondary emission of sputtering phenomena are not possible. It has been found that when a body comprised of a three dimensional network defining a multiplicity of interconnecting free cells is impinged upon by molecular, atomic or subatomic particles, having sufficient energy to cause secondary emission or sputtering, there is a reduced secondary emission and sputtering when compared to traditional surfaces.

In the broadest sense of the present invention the body may be of any material capable of being fabricated into a three-dimensional structure defining a multiplicity of interconnecting free cells.

However the material should be capable of withstanding the conditions of manufacture and use of the device in which the surface is to be situated.

Non-limiting examples of materials suitable for use as the three dimensional network are graphite, nickel, chromium, iron, titanium, tungsten, cobalt, molybdenum and alloys of these materials between themselves and with other materials.

In general the cell size of the body material is any size that can be conveniently produced with the material to be used for the body. The preferred cell size is less than 10 cells per inch and preferably less than 25 cells per inch.

At a lower number of cells per inch the body is too transparent and is not able to collect the primary particles unless there is an excessive thickness of the three dimensional network comprising the particle collecting body. There is essentially no upper limit to the number of cells per inch except that imposed by present technology in fabricating such three dimensional networks.

The present limit is about 200 cells per inch but there is no reason why networks having a higher number of cells per inch should not be useful in the present invention.

When a primary particle passes through the surface, which defines the volume containing the three-dimensional networks, in general it does not impinge directly upon the material constituting the network but passes through the spaces therein. After passing some distance below the surface the primary particle strikes the material constituting the network and, depending upon the nature of the primary particle, its energy and the nature of the material constituting the network, causes the varying degrees heating, sputtering and or secondary particle emission. This sputtering or secondary particle emission now takes place in a zone at least partially enclosed by the three dimensional network. Thus the secondary particles are more likely to re-collide with the structure of the material constituting the network than escape from the surface. In this way the sputtered atoms or particles emitted are effectively trapped. It will be appreciated that a certain percentage of the primary particles will impinge upon the material, constituting the network, in the region near the surface defining the volume containing said network. However this percentage is generally no more than about 10 to 20 percent of the incident primary particles. The actual percentage depends upon the thickness of the individual arms of the network relative to the cell size. A measure of this ratio is given by the ratio of apparent density of the three-dimensional network to the density of the bulk material constituting the network. The ratio of apparent density to bulk density should be between 1 to 2 and 1 to 100 and preferably between 1 to 5 and 1 to 50. At lower ratios of apparent density to bulk density the network has a low porosity and is incapable of trapping a sufficient proportion of primary particles and hence of sputtered or secondary particles. If the ratio of apparent density to bulk density is too high the network has too high a porosity and an excessive thickness of network is required to trap the primary particles.

DESCRIPTION OF A PREFERRED EMBODIMENT

Referring now to the drawings and in particular to FIG. 1 there is shown a particle trap 10 suitable for use in the present invention.

Particle trap 10 comprises a three dimensional network 11. Struts 12, 12′, 12″ of network 11 define open surfaces 13, 13′ etc. between interconnecting cells 14, 15 etc. within the three dimensional network 11.

Figure 2:
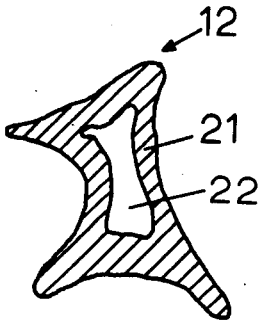
FIG. 2: is a cross-section taken along line 2—2 of FIG. 1.

FIG. 2 shows a cross section of strut 12 comprising an outer-wall section 21 and an internal space 22.

Figure 3:
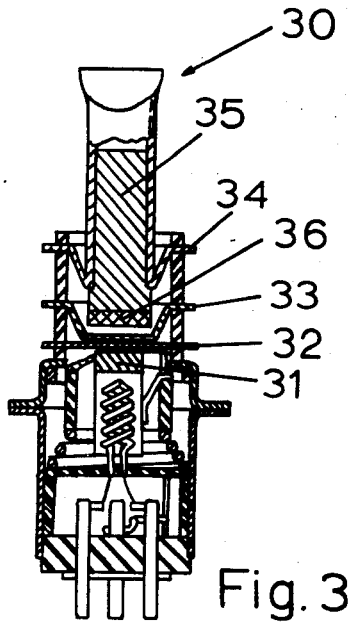
FIG. 3: is a cross sectional representation of an electronic valve using a body of the present invention.

FIG. 3 is a cross sectional representation of an amplifying tetrode 30 comprising a cathode 31 as a source of electrons, a control grid 32, a screen grid 33 and an anode 34. Anode 34 comprises a section 35 of high thermal conductivity and a section 36 of a three dimensional metallic network defining a multiplicity of interconnecting free cells. Section 36 is connected to section 35 by any suitable means well known in the art.

It will be appreciated that the network may be designed to perform contemporaneously other functions such as being capable of radiating heat energy. This can be accomplished by incorporating within the structure a layer of heat radiating particles such as graphite or other substances, suitable for use in vacuum, with a high heat radiative capacity.

The invention is further illustrated by the following examples. These non-limiting examples are illustrative of certain embodiments designed to teach those skilled in the art how to practice the invention and to represent the best mode contempled for carrying out the invention.

EXAMPLE 1

An electron tube is manufactured comprising a glass envelope a cathode, a control grid and a first anode. The material of the 1st anode is carbon black on sheet nickel. A second anode is also provided and held at such a potential, during normal operation of the electron tube such that it collects secondary electrons emitted from the first anode.

The electron tube is operated and the secondary electron current from 1st to 2nd anode is measured.

EXAMPLE 2

Over the first anode of the electron tube of Example 1 is place a sheet of three dimensional network defining a multiplicity of interconnecting free cells having 100 cells per inch. The network is made from nickel covered with carbon black. The network has an apparent density of about ⅛ that of the bulk nickel.

The electron tube is operated with the same conditions as in Example 1 and the secondary electron current from the 1st to 2nd anode is measured. The secondary electron current is found to be less than that found for Example 1.

Although the invention has been described in considerable detail with reference to certain preferred embodiments thereof, it will be understood that variations and modifications can be effected within the spirit and scope of the invention as described above and as defined in the appended claims.

What we claim is:

1. A charged particle accelerating or storage device in which at least a part of one electrode maintained at a positive potential comprises a section of high thermal conductivity connected to a charged-particle collecting body, the charged-particle collecting body comprising a 3-dimensional network defining a multiplicity of interconnecting free cells, the 3-dimensional network being made of a material selected from the group of a metal or an alloy of graphite, nickel, chromium, iron, titanium, tungsten, cobalt, and molybdenum, the three-dimensional network having dimensions selected to permit a major portion of charged particles incident on the charged-particle collecting body to penetrate a multiplicity of free cells before impinging on the material of the three-dimensionl network.

2. The charged particle accelerating or storage device of claim 1 wherein the dimensions of the network are such that there are more than 10 cells per inch.

3. The charged particle accelerating or storage device of claim 1 wherein the dimensions of the network are such that the ratio of apparent density of the network to the bulk density of the material comprising the network is between 1:2 and 1:100.

4. The charged particle accelerating or storage device of claim 3 in which the ratio of apparent density of the network to the bulk density of the material comprising the network is between 1:5 and 1:50.

5. The charged particle accelerating or storage device of claim 1 in which the ratio of apparent density of the network to the bulk density of the material comprising the network in between 1 to 2 and 1 to 100.

6. In a thermionic electron tube maintained at subatmospheric pressure, an anode maintained at a positive potential comprising a first section having a high thermal conductivity and a second section, connected to the first section, comprising a three-dimensional network of struts defining open surfaces between interconnecting cells within said three-dimensional network, each strut having a cross-section comprising an outer wall section and an internal space, each strut being made of a metal or an alloy of a metal selected from the group of graphite, nickel, chromium, iron, titanium, tungsten, cobalt, and molybdenum, the ratio of the apparent density of said network to the bulk density of the metal or alloy comprising the network being between 1:5 and 1:50, a major portion of the volume of said second section comprising inter-connected free cells arranged to permit a major portion of charged-particles incident on the second section penetrate a number of free cells before impinging on a strut of the three-dimensional network.

* * * * *